United States Patent [19]

Weske

[11] Patent Number: 5,051,213

[45] Date of Patent: Sep. 24, 1991

[54] METHOD AND APPARATUS FOR MIXING FLUIDS

[76] Inventor: John R. Weske, P.O. Box 116, Sandy Spring, Md. 20860

[21] Appl. No.: 39,871

[22] Filed: Feb. 24, 1987

Related U.S. Application Data

[63] Continuation of Ser. No. 766,429, Aug. 16, 1985, abandoned, which is a continuation-in-part of Ser. No. 752,491, Jul. 8, 1985, abandoned, which is a continuation of Ser. No. 523,796, Aug. 16, 1983, abandoned.

[51] Int. Cl.[5] ..... B01F 3/04

[52] U.S. Cl. ..... 261/78.2; 261/93; 261/120; 366/338

[58] Field of Search ..... 261/76, 78.2, 87, 91, 261/93, 116, 118, 120, 124, DIG. 15, DIG. 75; 210/219, 143, 221.2, 242.2; 239/8, 9, 110; 209/169, 170; 366/101-104, 107, 336-338

[56] References Cited

U.S. PATENT DOCUMENTS

| | | | |
|---|---|---|---|
| 366,169 | 7/1887 | Hyatt | 261/DIG. 75 |
| 1,526,041 | 2/1925 | Bancel | 261/76 |
| 2,295,391 | 9/1942 | Durdin, Jr. | 210/143 |
| 2,762,202 | 9/1956 | Ponsar | 261/DIG. 75 |
| 3,521,864 | 7/1970 | Welles, Jr. | 261/91 X |
| 3,555,786 | 1/1971 | Cochran | 261/112 X |
| 3,643,403 | 2/1972 | Speece | 261/91 X |
| 3,875,279 | 4/1975 | Kaelin | 261/91 |
| 3,887,660 | 6/1975 | Romantschuk et al. | 261/91 |
| 3,928,199 | 12/1975 | Kirk et al. | 261/DIG. 75 |
| 4,051,204 | 9/1977 | Muller et al. | 261/93 X |
| 4,117,048 | 9/1978 | Stockner et al. | 261/93 |
| 4,215,082 | 7/1980 | Danel | 261/124 |
| 4,271,099 | 6/1981 | Kukla | 261/76 |
| 4,304,740 | 12/1981 | Cernoch | 261/DIG. 75 |
| 4,337,152 | 5/1982 | Lynch | 261/DIG. 75 |
| 4,409,100 | 10/1983 | Rajendren | 261/DIG. 75 |

FOREIGN PATENT DOCUMENTS

| | | | |
|---|---|---|---|
| 371373 | 6/1983 | Austria . | |
| 0031166 | 1/1981 | European Pat. Off. . | |
| 800834 | 7/1936 | France | 261/76 |
| 1484657 | 9/1977 | United Kingdom | 261/DIG. 75 |

*Primary Examiner*—Richard L. Chiesa

*Attorney, Agent, or Firm*—Berman, Aisenberg & Platt

[57] ABSTRACT

Method and apparatus are disclosed which are used to mix two fluids, two gases, or a fluid and a gas. The preferred embodiment is useful primarily for the aeration of water but can be used to mix any gas with a liquid. The method involves creating relative movement between an elongate element and a fluid whereby a low-pressure area will be developed on the lee side of the element. The gas is then admitted to the low-pressure area and bubbles are formed. The element is preferably pointed to form a tine, and the bubbles are moved along the tine by a component of the relative motion toward the tip. When the bubble reaches the tip it will be detached and entrained in the fluid. When a plurality of tines is used, significant air induction capacities are observed. one embodiment employs tines mounted to a rotating body and other embodiments use arrays of parallel tines mounted to fixed structures and immersed in a stream of fluid.

33 Claims, 7 Drawing Sheets

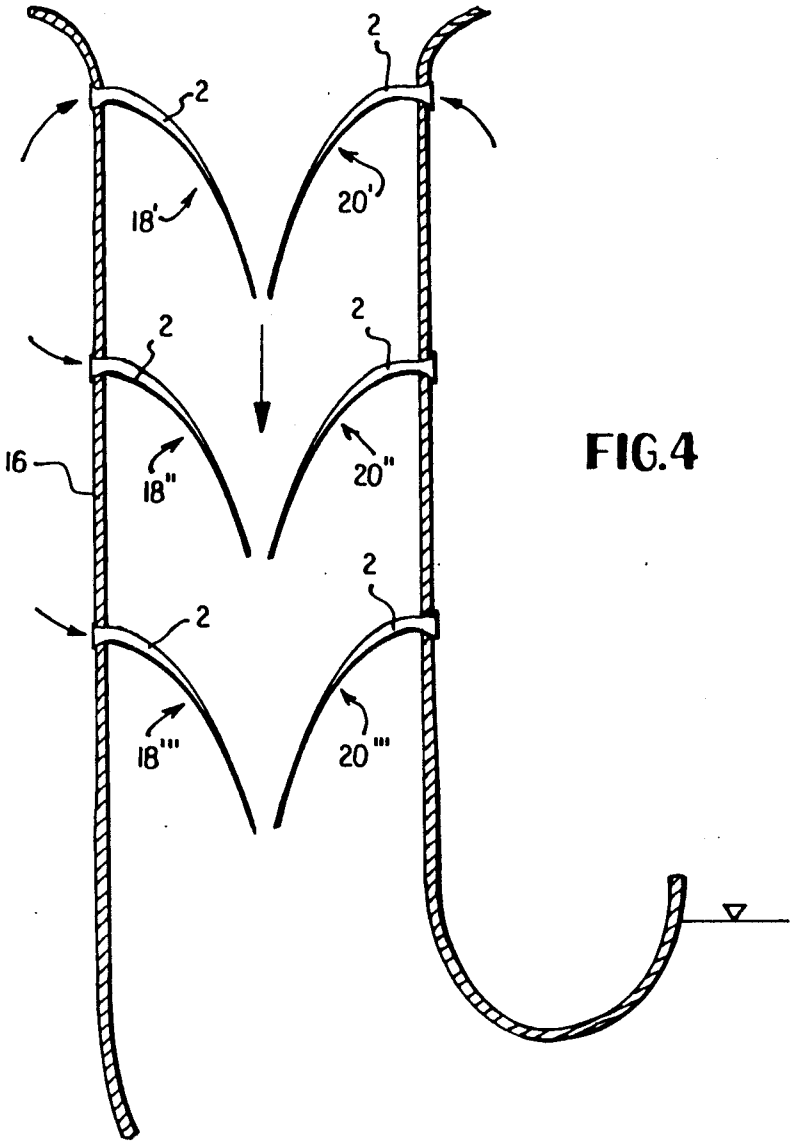
FIG.4
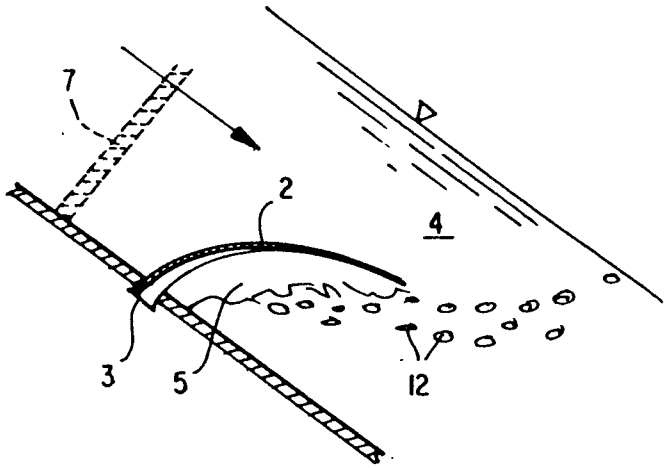
FIG. Id

METHOD AND APPARATUS FOR MIXING FLUIDS

This is a continuation of Ser. No. 06/766,429 filed Aug. 16, 1985, now abandoned, which was a continuation-in-part of Ser. No. 06/752,491, filed July 8, 1985, now abandoned, which was a continuation of Ser. No. 06/523,796, filed Aug. 16, 1983, now abandoned.

TECHNICAL FIELD

This invention relates to the art of mixing fluids; particularly, the art of mixing a gas with a liquid. In the preferred embodiment, the invention relates to the art of aeration of a liquid.

BACKGROUND ART

Many methods and apparatus are known which are employed for mixing two fluids. In many of these a low pressure area is created in a first fluid, and a second fluid to be mixed with the first fluid is admitted to the low pressure area. In processes which relate to gasification of a fluid, one method employs a venturi to create a pressure lower than atmospheric to pull air into a flowing fluid stream.

One such shown in U.S. Pat. No. 3,853,271 (Freshour et al). This system includes a plurality of cup-shaped members. A fluid flows through the central portions of the members, and a low pressure area is pulled in from the exterior of the cups to mix with the flowing fluid Another such venturi system is shown in U.S. Pat. No. 4,017,565 (Muller). This patent shows a system for mixing a gas with a liquid wherein a pump circulates a liquid in a container. The liquid is pumped through a cylindrically symmetric baffle which provides an annular constriction for increasing the velocity of the circulating liquid. This increased velocity creates the venturi effect whereby air from a tube aligned with the axis of the baffle is admitted to the flowing liquid.

Venturi systems have several drawbacks which particularly prevent efficient mixing of a gas with a liquid. A venturi system requires a large duct-to-throat area-ratio to create the low pressure required to induce air. A duct-to-throat ratio of 5 is not uncommon, and this means that the kinetic energy in the throat is 25 times that in the duct. The subsequent reduction in flow velocity in the diffuser results in large flow losses which prevents recovery of the kinetic energy investment made in the throat. Further, the air inducted in the throat is usually composed of large bubbles which must be transported through the diffuser and broken up by additional elements, such as a pump impeller, if the gas-liquid surface area is to be increased.

It is also known to provide a vortex for pulling air into a fluid. U.S. Pat. No. 4,259,267 (Wang) shows an apparatus wherein a single propeller is located in a fluid beneath a plurality of vertical, cylindrical tubes. As the propeller pulls the fluid through the tubes, a vortex develops in each tube thus entraining gas into the center of each vortex.

It is further known to simply pump air under pressure into a body of fluid. U.S. Pat. No. 3,643,403 shows an apparatus wherein air is pumped to a disperser located in the body of the fluid. An impeller is located above the disperser and circulates fluid so that bubbles which are emitted from the disperser flow downwardly with the fluid flow to thereby increase the time of contact of the bubbles with the fluid. U.S. Pat. No. 2,479,403 shows a system wherein aeration of sewage is effected by the action of a submerged water-jet injector. British Patent 1,484,657 shows a system wherein air is injected under pressure into a downwardly flowing stream so that the contact time of air bubbles with the fluid is increased.

The common faucet aerator is also known wherein flowing water is caused to be turbulent so that air is drawn in by a process similar to the injector effect. U.S. Pat. No. 4,214,702 (Shams et al.) shows such a faucet aerator.

Another aerator, shown in U.S. Pat. No. 2,295,391 (Derden, Jr.) uses a pump to circulate fluid between a container and a chamber containing a gas. The fluid flows turbulent mixing of the fluid with the gas.

Another aeration apparatus is shown in U.S. Pat. No. 3,591,149 (Auler). This apparatus includes a plurality of blades which rotate about a single vertical axis. The blades are elongate and extend into the fluid so that when the blades are rotated, fluid flows in an upward direction along one side of each blade. The resulting turbulence causes aeration of the fluid.

SUMMARY OF THE INVENTION

Apparatus known in the prior art, such as those described above, suffer from several disadvantages. First, they have low efficiencies in that a large power input is required to cause a mixing of the air. Efficiency is typically measured in units of kilograms of oxygen transferred per kilowatt hour of input energy. Secondly, the prior art apparatus are complex and require structures which are expensive both to produce and to maintain.

The invention is a method and apparatus wherein a plurality of spike-like elements, or tines, are used to mix two fluid substances, preferably a gas with a flowing liquid, in a simple and highly efficient manner. The tines are caused to have motion relative to a fluid, and the tines extend into the fluid at an angle which is transverse to the direction of flow of the fluid. This produces a low-pressure area on the lee, or downstream, side of each tine, and a gas is admitted to this low pressure area. The low pressure area is created because flow past an immersed, blunt body separates from the body, and a region of low-speed flow forms immediately downstream of the body. This low-speed region is bounded on both sides by high speed flow. Large fluid shear stresses in the flow cause the pressure on the downstream side of the obstacle to be considerably lower than the free stream static pressure. As the gas is pulled into the low-pressure area, an air cavity begins to form with an irregular, curved shape, varying as the turbulence of the flowing liquid on the lee side of a tine distorts the gas-liquid interface. Surface tension acts to pinch off parts of the gas to create a bubble, and as the bubble forms, it becomes an obstacle to the surrounding flow. Drag forces then act upon the bubble to move it along the tine and to entrain the bubble in the fluid flow. The tine is placed at an angle to the flowing liquid and a component of the flow is directed along the tine toward the tip of the tine which extends into the fluid. The bubble is thus pulled along the tine by this component until it reaches the tip of the tine. At this point, if not already on the way to the tip, the bubble is detached from the tine and becomes entrained in the flowing liquid. In a preferred embodiment, the tine is parabolic so that the base is perpendicular to the flow and the tip is at a slight angle to the flow. This maximizes both the low pressure at the area where the air cavity is formed and the ability of the flow to pull the bubbles from the tine into the fluid.

If the flow velocity of the liquid in a downward direction is larger than the upward velocity of the gaseous bubble relative to the liquid due to its buoyancy, the bubble will be carried with the flow of the fluid and will eventually dissolve into the liquid. This process is preferably made continuous by providing a series of bubbles which are continuously formed and entrained in the flowing fluid. When the admitted gas is air, five to ten percent of the oxygen contained in the air is transferred to liquid water. Transfer of oxygen across the air-water interface continues as long as the bubbles are in contact with the fluid, and the rate depends upon the relative velocities and the relative concentrations. Of course, other constituents of the air bubble also pass across the gas-liquid interface.

The above-described process is very simple, requires very few moving parts and may be operated with a low head of water. The tine may be placed in a naturally flowing stream, such as in a river or in the outflow of a dam. A ramp having tines extending upwardly into the flow has been found particularly useful. Alternatively, a pump may be used to circulate the fluid of a pond over the tines to produce aeration. The air introduced by a single tine may be relatively small and, in the preferred embodiment, structures which employ a plurality of tines are preferred. These structures are easy to produce and to maintain. The are relatively inexpensive and are quite efficient.

In one embodiment, the tines are provided in parallel rows to form grids, and fluid is passed over these tine grids. In a second embodiment, the tines extend outwardly from a central body which is rotated in a stationary fluid.

Experiment has shown that turbulence in the fluid helps dislodge bubbles from the tines. This turbulence may be created by providing a series of tines along the flow direction or by providing an obstacle such as a bar in front of a tine.

It is an object of this invention to provide method and apparatus for mixing fluids.

It is a further object of this invention to provide method and apparatus for mixing a gas with a liquid by the creation of a low pressure area in the liquid whereby gas bubbles are formed and become entrained in a flowing liquid.

It is a further object of this invention to provide method and apparatus for aeration of a flowing liquid wherein a plurality of tines extend transversely into flow of a liquid, and air is admitted to a low pressure area on the lee side of each tine.

BRIEF DESCRIPTION OF THE DRAWINGS

FIG. 1*d* is a cross section along a vertical plane of a preferred form of a tine in a flowing stream.

FIG. 4 is a vertical section through an embodiment similar to that of FIG. 2 but with a cascade arrangement of the tines.

DETAILED DESCRIPTION OF THE PREFERRED EMBODIMENTS

Figure 1A:
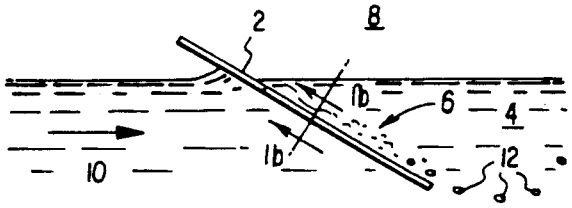
FIG. 1*a* is a side view illustrating a principle feature of the invention.

A basic principle of hydrodynamics on which the invention relies may be described with respect to FIG. 1*a*. A tine 2 is located in a stream of flowing liquid 4, and a low pressure area develops in the downstream, or lee, portion 6 of the tine 2. A gas (such as air) is drawn into the fluid at the low pressure area 6 since the hydrostatic pressure in the area 6 is less than the pressure of the gaseous region 8 adjacent the flowing liquid 4.

The direction of flow of fluid 4 is indicated by arrow 10 and it will be appreciated that since the tine 2 is transverse to the direction of flow, there will be a component of the flow velocity normal to the tine and a component along the tine. The component of flow normal to the tine causes the development of the low pressure area 6, and the component of the flow along the tine causes the air which has been drawn into the low pressure area to move along the tine. As the air moves along the tine, it forms bubbles 12, and these bubbles are swept off the end of the tine and into the flowing liquid 4. While the bubbles are carried along by the liquid, transfer of the gas which forms the bubble takes place across the gas-liquid interface as dictated by the concentration gradient.

A tine may thus be viewed as having two parts with essentially distinct functions. The first part near the base creates a low pressure area to induct a fluid such as air, and the second part conveys globules from the low pressure area into higher pressure prevailing in the flowing fluid without requiring any other structure.

Figure 1B:
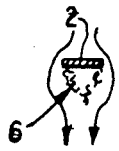
FIG. 1*b* is a cross section taken along line 1*b*—1*b* of FIG. 1*a*.

FIG. 1*b* shows a cross section of the tine 2 taken along the line 1*b*—1*b* of FIG. 1*a*. This illustrates how the liquid 4 flows around the tine and creates a low pressure area 6.

Figure 1C:
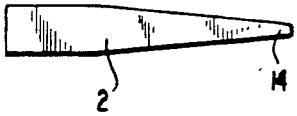
FIG. 1*c* is a plan view of the element shown in FIG. 1*a*.

A preferred form of a tine is shown in plan view in FIG. 1c. The tine shown there is longer than it is wide, the preferred ratio being about 5:1, and it narrows to a tip 14. This preferred shape of the tine 2 allows the bubbles to be easily discharged from the end of the tine because the drag on a bubble increases as it moves toward the tip of the tine. The tine is preferably from ¾ to one inch in length, or longer.

FIG. 1d illustrates another preferred form of a tine and shows how bubbles are formed. Tine 2 of FIG. 1d is curved in the direction of flow of liquid 4 and is preferably parabolic. In this embodiment, the tine 2 extends from the bottom of a flow channel or from the wall of a duct, and air is supplied through an opening 3.

The embodiment of FIG. 1d is particularly advantageous because the lower part of the tine is essentially perpendicular to the direction of flow to provide the low pressure area, while the tip of the tine is almost parallel to the flow direction to cause large drag to assist in dislodging bubbles. Bubble formation as shown in FIG. 1d typically includes formation of an air plume 5 from which bubbles 12 are formed.

It has been found advantageous to provide some turbulence in the fluid 4 to further assist in dislodging bubbles 12. This turbulence may be caused in several ways, one of which is bar 7, which is illustrated in FIG. 1d in dashed lines. Bar 7 is placed in front of a tine and causes liquid 7 to be turbulent enough to jostle plume 5 to cause bubbles to be dislodged. Another technique for causing turbulence is to place tines in series such that their wakes interfere, and embodiments employing this feature will be described below.

Practical embodiments for employing the above-described tines to gasify fluids are shown in the remaining figures.

Figure 2A:
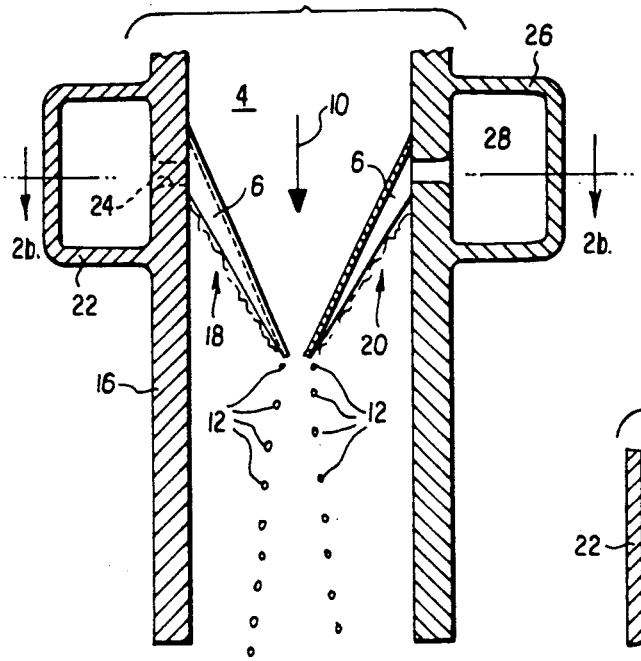
FIG. 2*a* is a cross section of a first embodiment of the invention.

FIG. 2a shows an embodiment wherein fluid 4 flows downwardly through a channel 16 of essentially constant crosssection. The channel cross section may be a variety of shapes, but preferably has at least two side walls which are parallel. A first array or grid 18 of tines is placed on one side of the channel, and a second array or grid 20 is placed on an opposed side of the channel. The tines of each tine grid extend in the direction of constant static pressure. As the fluid 4 flows through the channel 16, it encounters the pair of oppositely arranged tine grids 18, 20 and a low pressure area 6 is developed in the lee of each tine of each grid. The tines extend outwardly from the channel so that they form an angle of 30 to 45 degrees as shown with the direction 10 of the flow of the liquid or else they may be of parabolic shape as in FIG. 1d.

A first manifold 22 allows the passage of gas therethrough, and a passage 24 in the channel 16 allows the manifold 22 to communicate with the lee side of each of the tines in grid 18. A similar manifold 26 is located on the opposed side of the channel 16 and communicates with the lee side of the tines in the grid 20 by way of passage 28. The manifolds 22 and 26 may be connected to a common source of gas.

It will thus be appreciated that as the fluid 4 flows through the channel, gas is drawn through the manifolds 22 and 26, passages 24 and 28, and into the low-pressure areas 6 on the lee side of each tine in the grids 18 and 20. Bubbles 23 are formed in the manner described above with respect to FIG. 1a, and these bubbles are swept off the tips of the tines and into the flowing liquid 4.

The channel 16 may have an essentially constant cross section because the low pressure needed to draw in air is created by the tines and not by the shape of the channel. Because air is drawn into the liquid, it may be desired to slightly increase the area to allow for the increased volume while keeping the velocity constant.

Since the bubbles have buoyancy, they will tend to rise in the fluid 4. The downward velocity of flow of the fluid is, thus, preferably greater than the upward velocity of the bubbles so that the bubbles will be carried into the liquid 4. This provides contact between the air in the bubbles and the fluid for a substantial period of time and allows a substantial amount of the gas to pass through the air-liquid interface and into the fluid 4.

Figure 2B:
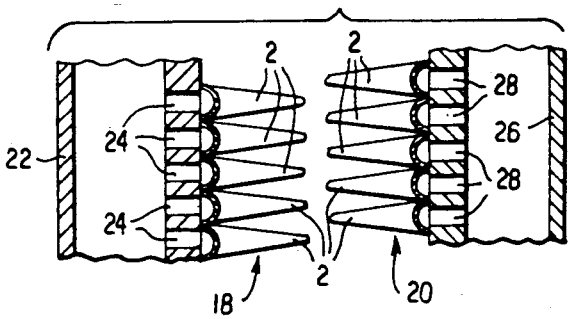
FIG. 2*b* is a cross section along line 2*b*—2*b* of FIG. 2*a*.

FIG. 2b shows a cross section taken along line 2b—2b of FIG. 2a. The plurality of tines 2 in each array can be seen from this figure. It is also seen how the plurality of passages 24 and 28 provide communication with each of the tines so that air is drawn into the lee side of each tine to form bubbles as described with respect to FIG. 1a. The tines are preferably slightly curved in the plane transverse to their length to present a convex face to the upstream side of the flowing liquid, and a concave face to the downstream side. They are preferably flat at their tips.

While two arrays of tines have been shown in FIGS. 2a and 2b, it is sometimes desired to provide additional arrays downstream of those which are shown. Such a cascade embodiment will be more fully described with respect to FIG. 4.

Figure 3A:
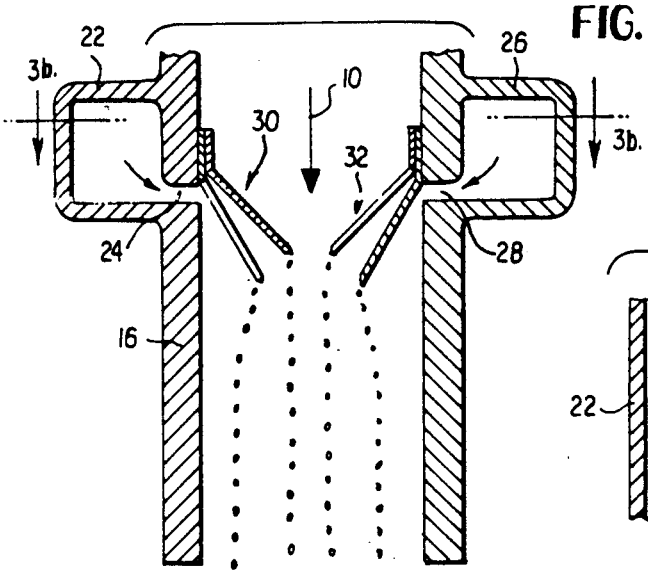
FIG. 3*a* is a cross section similar to that shown in FIG. 2*a* but showing a different arrangement of tines.

FIG. 3a shows a modification of the apparatus described in FIG. 2a. The tine grids used in FIG. 3a provide a plurality of tines at different angles to increase the rate of bubble formation. A first grid 30 is placed on one side of the channel 16 and a second grid 32 is placed on an opposite side. Some of the tines are located at a first angle with respect to the direction of flow 10 of the liquid and other tines are located at a different angle. This arrangement provides twice as many the angles at which the tines extend into the flow are such that efficient operation of the apparatus for each tine grid is maintained. That is, the arrays form an angle with the direction of flow of between 30 and 45 degrees.

Figure 3B:
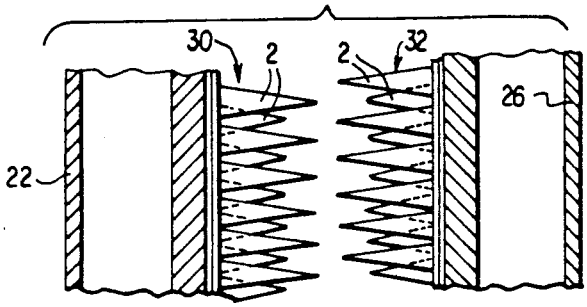
FIG. 3*b* is a cross section taken along line 3*b*—3*b* of FIG. 3*a*.

FIG. 3b shows how the tines 2 are interleaved to provide an increased number of tines, thus providing increased air induction capacity.

The flow of fluid 4 may be provided by any known means. For example, a pump may raise a fluid from a tank and direct it through the channel 16. Alternatively, the channel 16 may be placed in a naturally flowing stream, such as an outlet from a dam so that water will fall by the force of gravity through the channel 16 and become aerated.

A head of water as low as one foot is sufficient to operate this kind of aeration device.

FIG. 4 shows a particularly advantageous embodiment of the invention. A channel 16 has a plurality of vertically oriented grids of curved tines 2, each of which is similar to that shown in FIG. 1d. The tines are arranged horizontally to provide arrays 18', 18'', 18''' and 20', 20'' and 20''' similar to those shown in FIG. 2b.

The duct has an essentially constant cross-section, in which case the velocity of the first fluid is the same past all tine grids. It will be appreciated that the velocity in the duct depends only on the cross-sectional area of the duct, and the tines have effectively no effect on the , velocity. The nominal or mean velocity may be defined as $V = Q/A$ where Q is the volume rate of flow of the incompressible fluid and A is the cross-sectional area of the duct.

The vertical distance between consecutive arrays, such as 18' and 18'', is such that the pressure of the downwardly-flowing fluid remains the same at each tier. This is accomplished by making the differences of potential head between adjacent tiers of grids equal to the flow loss of each tier of grids 18', 20'; 18'', 20''; and 18''', 20'''. This equality of pressures occurs at a particular fluid velocity in the duct and is a maximum efficiency configuration.

Ducts with multiple tine grids in cascade may be operated also at velocities slightly lower or slightly higher than this particular velocity at somewhat reduced efficiencies.

If a duct is designed so that the static pressure of the flowing liquid at each of the tine grids is atmospheric, air will be inducted solely by the action of the tines. For example, the embodiment of FIG. 4 can be designed so that the static pressure at each tier of grids is atmospheric by equating the flow losses and potential heads as described above and by making the velocity head in the duct equal to the inlet head of the first grid. Then, if it is desired to increase the rate of air induction, the downstream water level can be lowered to provide a siphon effect which reduces the static pressure at each grid below atmospheric and accordingly increases the rate of air induction. This increases the flow velocity which in turn requires the spacings of the tine grids to be increased to provide equal pressures and maximum efficiency. The above applies only to ducts extending to below the downstream water level.

For example, if it is desired to increase the air intake capacity of a given duct slanting with respect to the vertical and operating at atmospheric pressure this may be achieved by lowering the downstream water level. Thereby the total head across the duct will be increased and with it the water velocity and the rate of water flow in the duct. The flow losses across the tine grids will be increased. To reestablish constant pressure at all grids, this time at a level below atmospheric, the vertical distance between grids needs to be increased as by placing the duct at a slant closer to the vertical. All design and performance data are calculable by normal procedures.

FIGS. 5*a*, 5*b*, 6*a*, 6*b*, 7, 8*a* embodiments of the invention which employs the principles described above. An axially symmetric body 34 is mounted to a shaft 36 for rotation. The shaft 36 is rotated, for example, by a motor 38. A plurality of tines 2 are attached to the perimeter of body 34 at equal spacings and extend outwardly therefrom. The tines also slant downwardly at an angle of about 45 degrees with respect to the axis of rotation. The tines are curved backwardly with respect to the direction of rotation of the body 34 preferably in parabolic fashion. As the body 34 rotates, the tines move with respect to the fluid 4. This implies that a low pressure area exists on the lee, or concave, side of each tine 2. Also, the fluid between the tines begins to rotate in the direction of rotation of the body and thereby, additionally, a low pressure is created at the roots of the tines by centrifugal action. A collar 40 is mounted either fixed or for rotation with the body 34 and provides an open channel for gas to be admitted to the lee side of each of the tines 2. Thus, as the body 34 is rotated and the pressure on the lee side of the tines decreases below the pressure prevailing in the area within the collar 40, air is drawn in through the collar 40 and passes along each tine where bubbles are formed and dispersed into the fluid 4.

Liquid is also pulled into the spaces between the tines from above and below the tines. This creates two toroidal systems of circulation as indicated by arrows C in FIG. 5*a*.

Bubbles are formed and are swept into the stream of circulating water until they rise to the surface of the liquid. The gaseous constituents of the bubbles pass through the gas-liquid interface as a function of contact time and relative velocities and concentrations.

If the collar 40 is supplied with gas at a pressure higher than atmospheric, the rotor may be immersed more deeply in a tank. This would be useful if it were desired to aerate a deep tank by placing the rotor near the bottom of the tank and connecting the collar to a high-pressure hose.

Figure 5A:
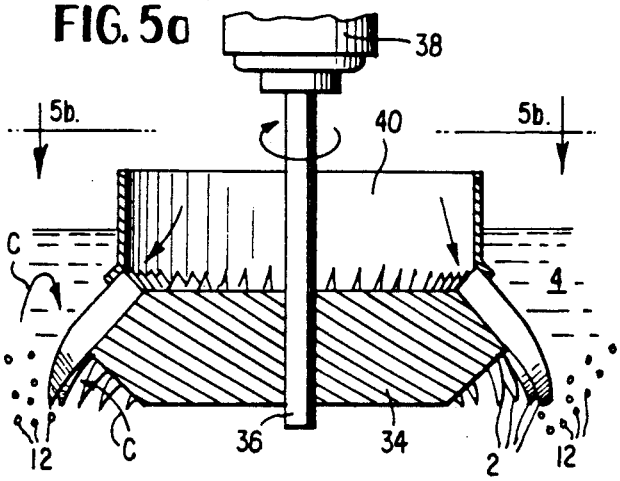
FIG. 5*a* is a cross section of a rotational embodiment of the invention.
Figure 5B:
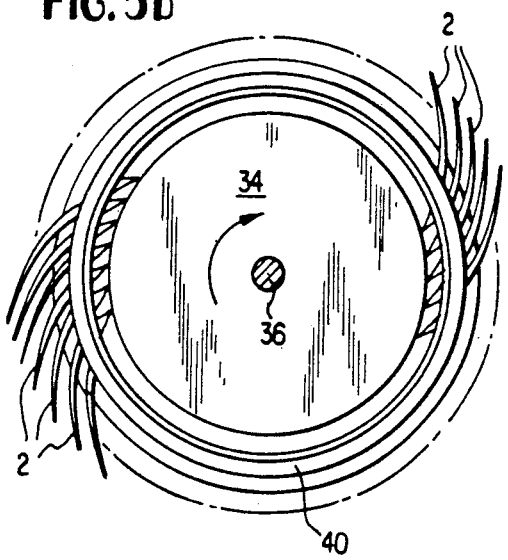
FIG. 5*b* is a view taken along line 5*b*—5*b* of FIG. 5*a*.

FIG. 5*b* shows a view taken along line 5*b*—5*b* of FIG. 5*a* . This figure shows how the tines 2 are curved to provide the angular relationship with respect to the fluid 4 which was described above with respect to FIG. 1*a* or else they may be of parabolic shape. As the body 34 rotates, there will be relative motion between the tines 2 and the fluid 4, and the low pressure area 6 will develop. Gas will then be drawn in through the collar 40 and into the fluid.

Figure 6A:
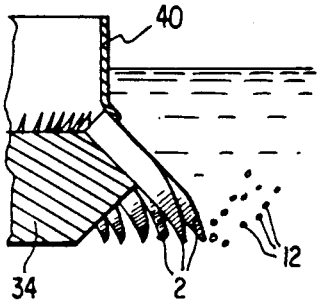
FIG. 6*a* is a detail of a rotational embodiment similar to that shown in FIG. 5*a* but having a different tine arrangement.

FIG. 6*a* shows a tine rotor wherein two rows of tines 2 extend from the rotating body 34 at different angles. This doubles the number of tines mounted to the body 34 and thus increases the air induction capacity since the number of sources is doubled without a correspondingly larger increase in the required input power.

Figure 6B:
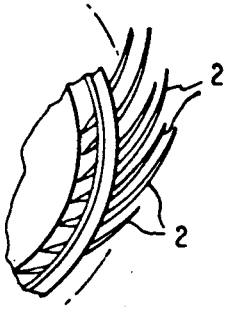
FIG. 6*b* is a plan view of the apparatus shown in FIG. 6*a*.

FIG. 6*b* shows a plan view of the embodiment shown in FIG. 6*a* and shows the interleaving of the tines 2.

Figure 7:
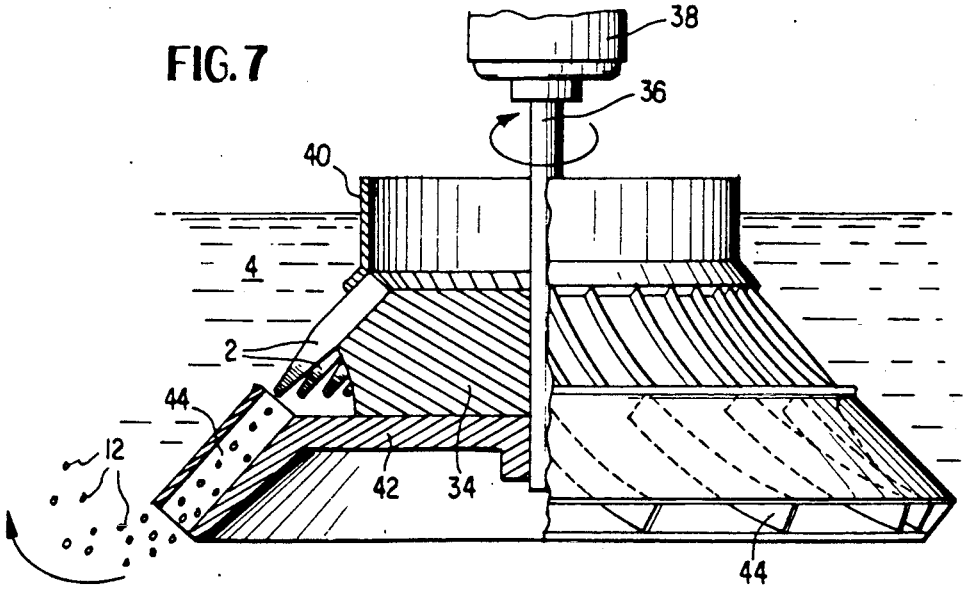
FIG. 7 is a side view, having a partially cut-away portion, showing a further modification of the rotational embodiment of the invention.

FIG. 7 shows an embodiment similar to that shown in FIG. 5*a*, but wherein an impeller is combined with body 34. The tines 2 serve to entrain air bubbles into a downwardly flowing stream, and the impeller conveys this stream to a greater depth by adding a downward velocity. This increased downward velocity prolongs the time of contact of the bubbles 12 with the fluid 4 to increase the amount of gas which is dissolved into the fluid 4. An impeller 42 is connected to the shaft 36 below the rotating body 34 so that impeller 42 rotates with body 34. The impeller includes a plurality of impeller blades 44 which receive fluid flow from the tines 2, and the rotating impeller blades 44 causes the fluid 4 and the entrained bubbles 12 to continue their flow downwardly and outwardly after leaving tines 2. The impeller is advantageous because it is more efficient at pumping the fluid than are the tines.

Figure 8B:
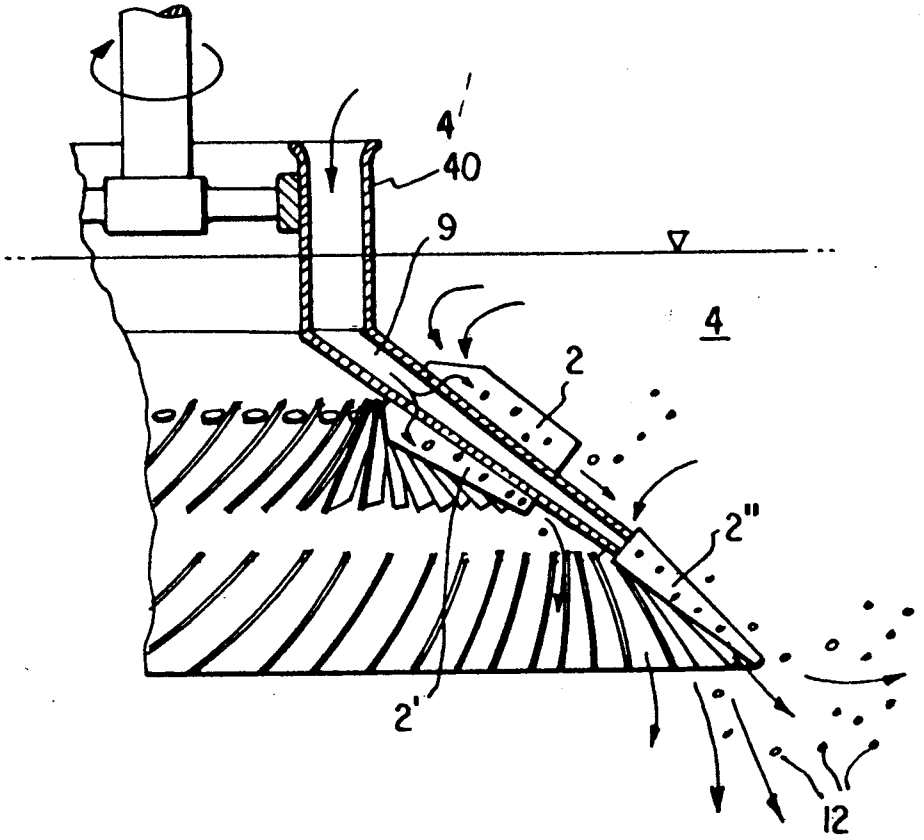
FIG. 8*b* is a cross section through a vertical plane of the embodiment of FIG. 8*a*.
Figure 8A:
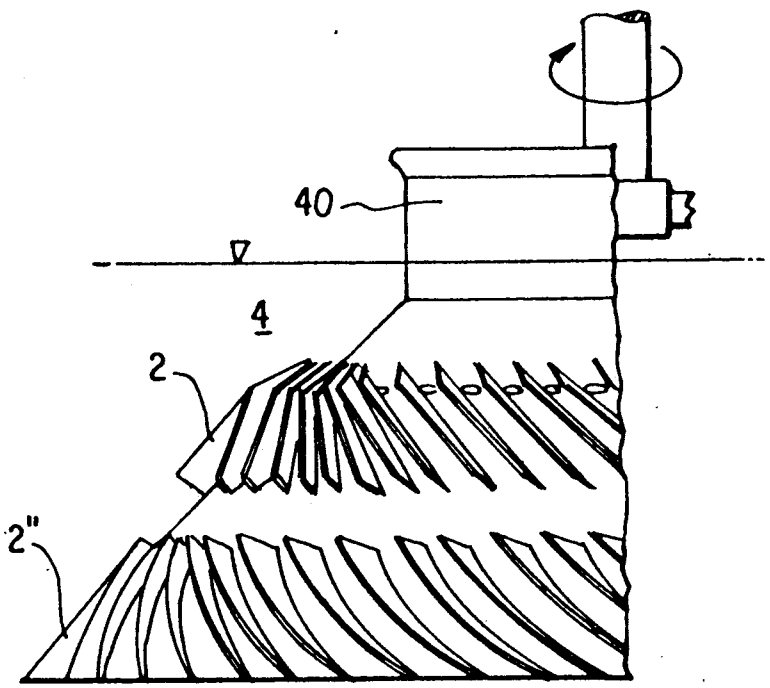
FIG. 8*a* is an elevation of another rotational embodiment.

FIGS. 8*a* and 8*b* show another rotational embodiment wherein a plurality of tines are arranged to make efficient use of the rotor's area. A first set of tines 2 is arranged in a manner similar to that of FIG. 5*a*. These tines create low pressure areas which communicate with a manifold 9 which in turn communicates with the atmosphere to allow the formation of bubbles. A second set of tines 2' is arranged on the underside of the rotor, and these also create low pressure areas which communicate with manifold 9 to form bubbles. A third set of tines 2'' is located at the lower edge of the rotor, and these also create low pressure areas which communicate with manifold 9. Preferably, the tines 2 and 2'' lie on a parabola having an apex at the surface of the liquid 4.

Figure 9A:
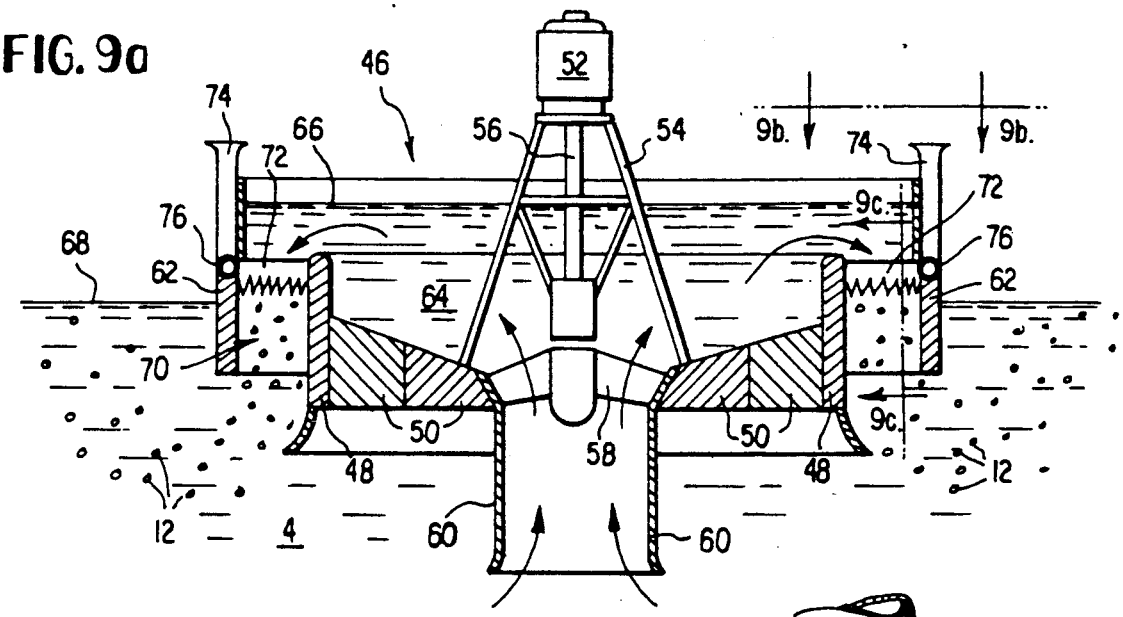
FIG. 9*a* is a cross section of an embodiment of the invention utilizing a floating structure.

FIG. 9*a* shows another embodiment of the invention. This embodiment is useful for aeration of a pond, and it employs a floating structure 46. A first cylindrical duct 48 is supported by flotation elements 50 which causes the entire structure 46 to float. A motor 52 is secured to a mount 54 which is in turn secured to the duct 48 and flotation elements 50 so that it rigidly supports motor 52. A shaft 56 extends downwardly from the motor 52 and is connected to a pump impeller 58. A second duct 60 is attached to the flotation structure and extends downwardly from the pump impeller to direct fluid 4 from the lake or pond to the impeller 58. The cylindrical duct 48 is surrounded by a third duct 62, and the upper edge of duct 48 is below an upper edge of the duct 62. When the motor 52 is activated, the pump impeller 58 draws water in through the duct 60 and creates a body of water 64 which has an upper surface 66 which is above the upper surface 68 of the pond 4.

Between the duct 48 and the duct 62 is a channel 70 through which fluid falls due to the fact that upper surface 66 is above upper surface 68.

A plurality of tine grids 72 are located in the channel 70 to cause aeration in accordance with the principles described above in connection with FIG. 1*a*. Tubes 74 provide an air channel to supply the tine grids 72 with air.

Figure 9B:
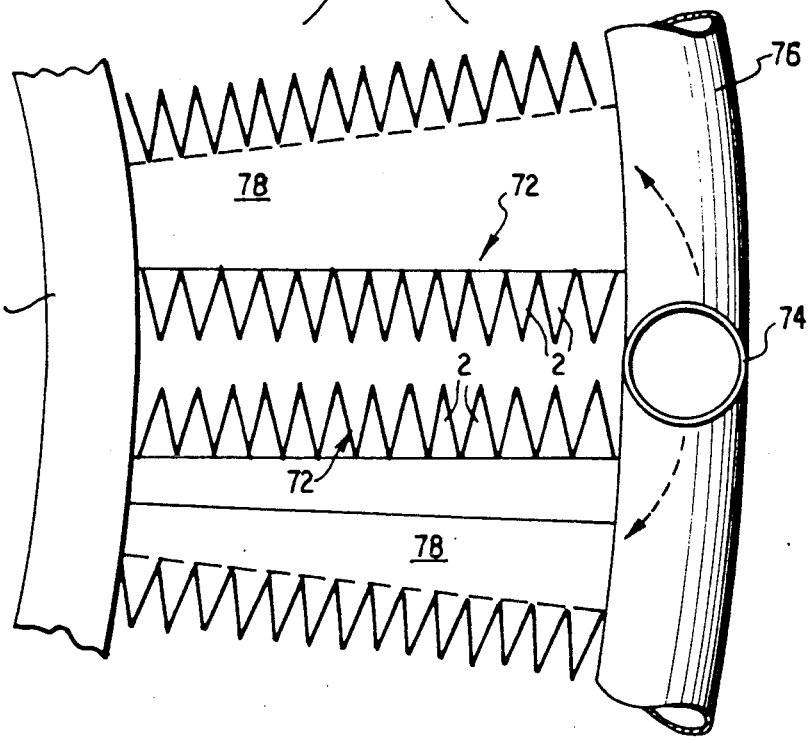
FIG. 9*b* is a view taken along line 9*b*—9*b* of FIG. 9*a*.

FIG. 9*b* shows a view taken along line 9*b*—9*b* of FIG. 9*a* and the tine grids 72 are more clearly visible in this figure. Also, a manifold 76 connected to tubes 72 is more clearly shown. Manifold 76 may be formed as a part of duct 62 or may be a separate element.

Figure 9C:
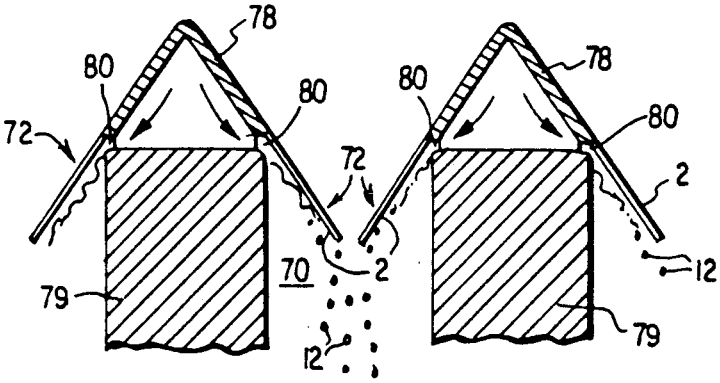
FIG. 9*c* is a cross section taken along line 9*c*—9*c* of FIG. 9*a*.

FIG. 9*c* is a cross section taken along line 9*c*—9*c* of FIG. 9*a* and shows how the tine grids 72 are arranged. Each of the tine grids 72 comprises a plurality of tines 2 which are similar to those described above with respect to the other embodiments. The tines are attached to peaked manifolds 78 which communicate with manifold 76. Each manifold 78 is mounted to a channel-defining plate 79 which extends between ducts 48 and 62. Passages 80 permit communication between the interiors of the manifolds 78 and the low pressure areas on the lee side of the tines 2 whereby air is drawn in through the tubes 74, the manifold 76, the manifold 78, and into the flowing fluid 4. Bubbles 12 are formed and are dispersed into the fluid 4 for gasification or aeration of the fluid.

Figure 11:
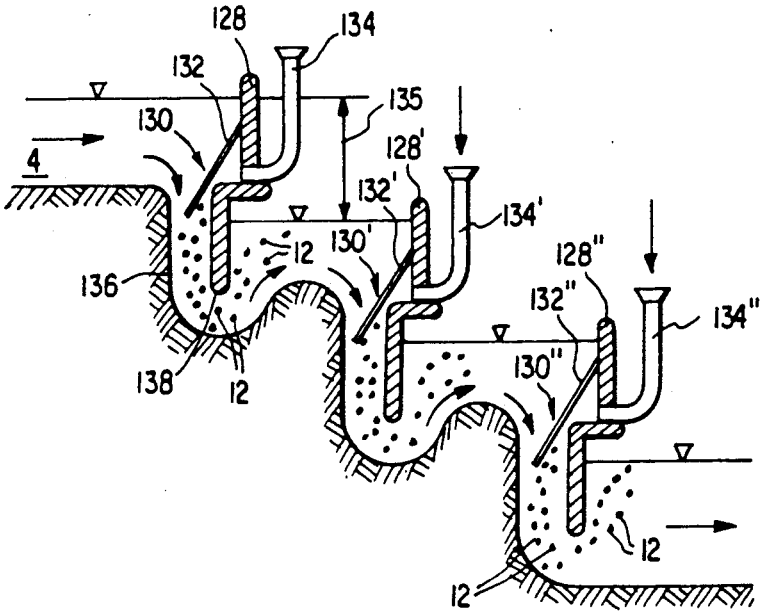
FIG. 11 is a cross section of an embodiment utilizing a cascade of a series of aerators in accordance with the invention.
Figure 12B:
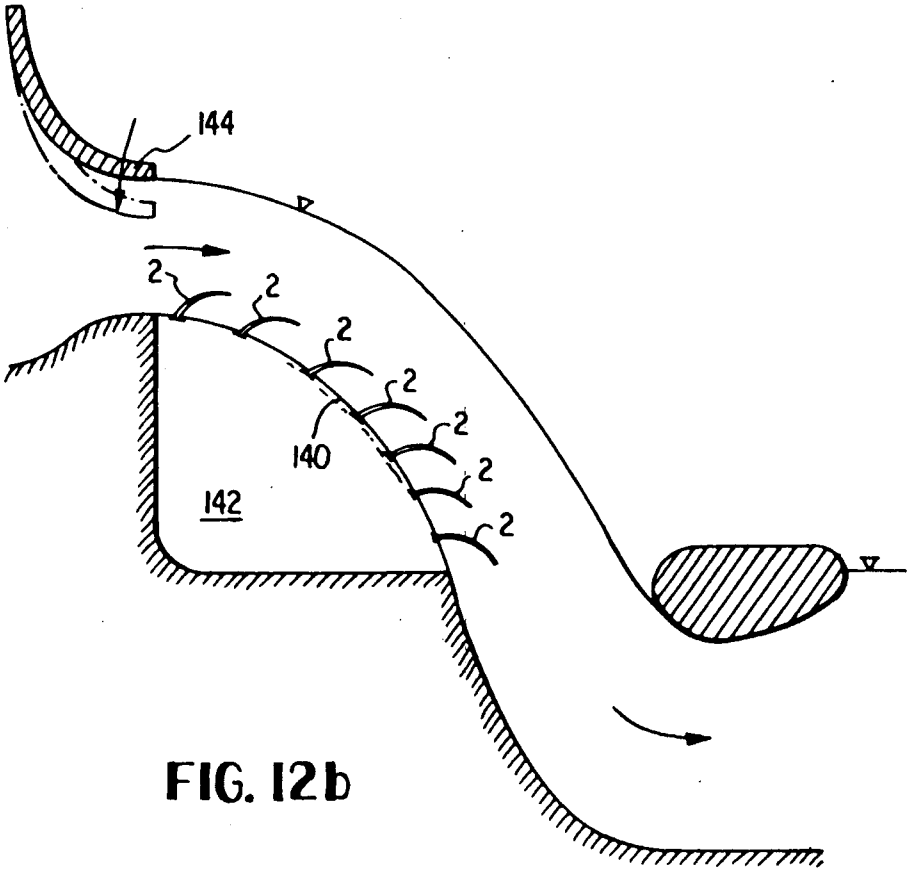
FIG. 12*b* is a vertical section of an embodiment similar to that of FIG. 12*a* except that the ramp is curved.
Figure 12A:
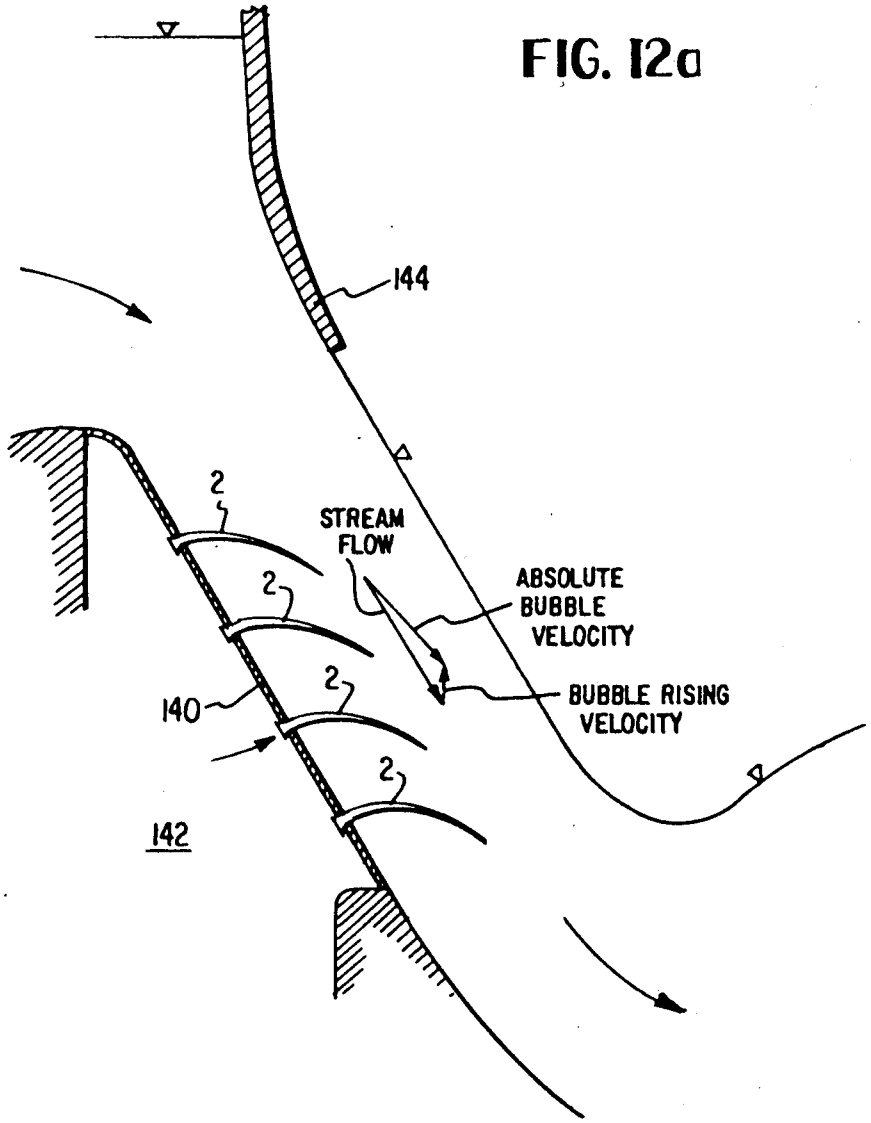
FIG. 12*a* is a vertical cross section of an embodiment of the invention using a flat ramp to direct fluid flow.

The embodiment according to FIGS. 9*a*—9*c*, in place of the channel with a single pair of tine grids, may be provided with a duct containing multiple tine grids arranged in tiers as shown in FIG. 4, or else with ramps as shown in FIGS. 12*a* and 12*b* or it may comprise a series of such fluid mixing units arranged in cascade as shown in FIG. 11.

The embodiment shown in FIGS. 9*a* through 9*c* may float in a pond or may be anchored to the floor of the pond or to the shore.

Figure 10:
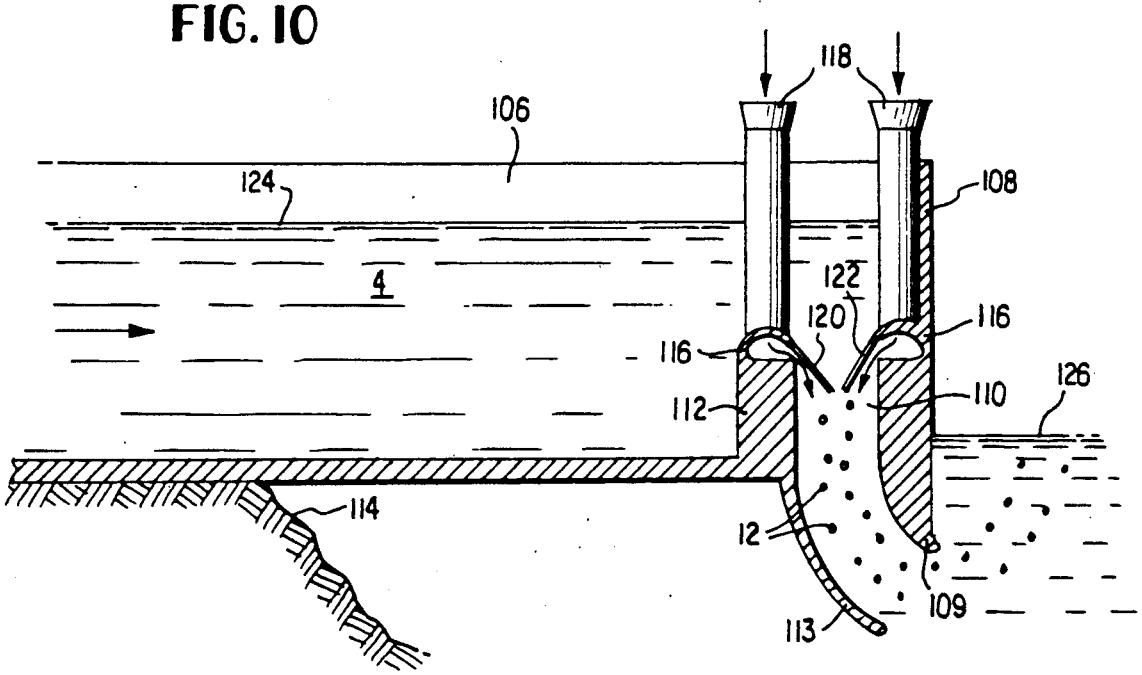
FIG. 10 is a cross section of a further embodiment of the invention.

FIG. 10 shows an embodiment which is useful for a flowing stream. A box 106 is open at a first, upstream end (not shown), and closed at a second, downstream end 108; the direction of flow is shown by the arrow. A channel 110 is formed between an upstanding edge 112 and the downstream end 108 of the box. An outlet channel is formed by portions 109 and 113. The box 106 may rest on the bottom 14 of a stream or may alternatively be secured in some other manner, such as by anchoring the box to the shore of the stream.

The upstanding edge 112 and the downstream end 108 each have a manifold 116 therein which communicates with a tube 118. A first tine grid 120 extends outwardly from the upstanding edge 112, and a second tine grid 122 extends outwardly from the downstream end 108.

The box 106 is placed in a stream so that it fills with fluid 4 such that the upper surface 124 of the fluid in the box is above the upper surface 126 of the fluid 4 in the river. The hydrostatic head created by this difference in height between surface 124 and surface 126 causes fluid to flow through the channel 110 thus creating low pressure areas on the lee side of the tines in the grids 120, 122 and thus drawing air through the tubes 118 and manifolds 116 as described above with respect to the other embodiments. Bubbles 12 are drawn off the tines 2 in the grids 120, 122, thus aerating the flowing stream.

It will be appreciated that the embodiments of FIGS. 9 and 11 may employ vertically arranged grids of curved tines similar to those shown in FIG. 4, if desired.

FIG. 11 shows an embodiment whereby a cascade arrangement permits an efficient use of a natural drop in a stream or the full head created by a pump. A first dam 128 is placed in a flowing stream 4 and a first array of spikes 130 extends outwardly from the dam 128. A manifold is formed along an upstream face of the dam 128 by plate 132 and adjacent portions of dam 128. The spike grid 130 communicates with the manifold, and a tube 134 communicates with the manifold to supply fresh air thereto.

A series of these arrangements is provided along the stream, and similar elements have been identified by primed and double primed numbers.

It will be seen that the upper edge of each dam 128, 128' and 128" is arranged so that a hydrostatic head 135 is developed between the surface level of the fluid behind each of the dams and the level downstream of the dam. As fluid flows through a channel between the stream bed and the dam 128, air is pulled in through tube 134 and manifold 132 because of the low pressure area developed on the lee side of the tines in the arrays. Bubbles 12 are thus formed to cause gasification or aeration of the fluid.

The arrangement shown in FIG. 11 also illustrates a U-shaped channel formed between the streambed 136 and the lower portion of the dam 128. This arrangement provides increased contact time of the bubbles 12 within the fluid 4 as the fluid flows under the bottom portion 138 of the dam 128. This arrangement tends to increase the efficiency of aeration since it provides for partial recovery of the immersion energy. As the air bubbles are conveyed downwardly, work is expended equal to the product of the depth of immersion and the weight of an equal volume of water. When the bubbles rise in the upward part of the channel, some of this work is recovered. This permits prolonged contact time without expenditure of power.

FIGS. 12*a* and 12*b* show embodiments which employ ramps to direct a flow of fluid over the tines 2. FIG. 12*a* shows a flat, generally planar, ramp while FIG. 12*b* shows a curved ramp. The ramps are formed by bottoms 140 which have tines 2 therein. The tines 2 communicate with manifolds 142 which are in turn connected to a source of air such as that shown in FIG. 11. Manifold 142 may be formed in any of several ways; for example, a trench, or the like, may be made in a stream bed and bottom 140 placed over the trench. Then, the stream is allowed to pass over the bottom 140 as shown. Deflectors 144, one of which is shown by phantom lines in FIG. 12*b* to be adjustable, may be used to control the thickness of the stream flowing over the tines.

The embodiments of FIGS. 12*a* and 12*b* are not shown in plan, but it is to be understood that tines 2 are preferably arranged in grids such as those shown in FIG. 2*b*. Preferably, adjacent grids are stepped horizontally such that a tine of an upstream array is opposite a space between tines in an immediately downstream grid.

The curved ramp embodiment of FIG. 12 has the particular advantage that centrifugal force created by the water flowing over the curved ramp adds to the low pressure created by the tine 2 to draw in more air. The curvature of the ramp may be designed such that the increase of low pressure resulting from centrifugal force is equal for all tines. Of course, the curvature of the ramp is limited because the flow will separate from the ramp if the curvature is too large. Also, if the effect of equal hydrostatic heads for all tine arrays, as described with respect to FIG. 4, is desired, the streamwise spacing of the arrays in the curved ramp embodiment will not be constant.

The flow of an entrained bubble is illustrated in FIG. 12*a*. A bubble has buoyancy which causes it to have a vertical component of velocity. This vertical component, when combined with the flow velocity of the stream, results in an absolute bubble velocity approximately as shown by the arrow which is so labelled in FIG. 12*a*.

The efficiency of aeration in accordance with the invention is estimated to be 2–3 $KgO_2/KWH$ embodiments and 3.5 $KgO_2/KWH$ for the rotational embodiment of small size where the higher figures apply to operation at reduced specific air intake rates. These estimates are based on test measurements using atmospheric air and a shallow draft.

While the invention has been described with respect to aeration and gasification, it will be apparent to those of ordinary skill in the art that several of the principles described may be employed with respect to mixing of two liquids, or two gases. Other modifications within the scope of the invention will be apparent to those of ordinary skill in the art.

What is claimed is:

1. A method for mixing a first fluid with a second fluid comprising providing a plurality of adjacent elongate elements, causing said first fluid to flow past said elongate elements, and supplying said second fluid, wherein each of said elongate elements comprises a first part essentially perpendicular to the direction of flow of said first fluid for creating a local low pressure area in said first fluid on the lee side of said first part for inducting said second fluid and forming globules of said second fluid, the pressure of said low local pressure area being lower than the pressure in said first fluid adjacent said local low pressure area, each of said elongate elements having a second part curving in a downstream direction from said first part to a tip portion forming no more than a small angle with said direction of flow of said first fluid and having a length of at least about ¾ inch for transporting said globules into said first fluid, wherein said step of supplying comprises supplying said second fluid to said local low pressure area through a passage in a flow confining wall, and said step of providing comprises arranging each of said elongate elements with respect to said flow of said first fluid so that at least a component of said flow is parallel to said second part whereby said globules are pulled along said second part from said local low pressure area into a higher pressure in said first fluid and into said flow.

2. A method according to claim 1 wherein said step of providing comprises providing a grid of said plurality of said elongate elements wherein each elongate element extends into said first fluid.

3. A method according to claim 2 wherein said step of causing said first fluid to flow comprises pumping said first fluid into a reservoir and allowing said first fluid to flow out of said reservoir and past said array.

4. A method according to claim 2 wherein said elongate elements are attached to an axially symmetric body and said step of causing said first fluid to flow comprises the step of rotating said body.

5. A method according to claim 2 wherein said step of causing said first fluid to flow comprises arranging said array on a wall of a duct and causing said first fluid to flow through said duct.

6. A method according to claim 5 wherein said duct extends in a vertical direction.

7. A method according to claim 5 wherein said duct extends at a non-zero angle to the vertical.

8. A method according to claim 1 wherein said first fluid is water and said second fluid is air.

9. Apparatus for mixing a first fluid with a second fluid comprising a plurality of adjacent elongate elements, means for supporting said elongate elements to extend into said first fluid to permit relative motion between said first fluid and said elongate elements, and supply means for supplying said second fluid, each of said elongate elements comprising a first part for creating a local low pressure area in said first fluid on a downstream side of said first part when said fluid moves with respect to said elongate element, the pressure of said local low pressure area being lower than the pressure in said first fluid adjacent said local low pressure area, each of said elongate elements further comprising a second part having a length of at least about ¾ inch connected to said first part and extending into said first fluid beyond said first part, wherein said supply means supplies second fluid through a passage in a flow confining wall to each of said local low pressure areas to form globules of said second fluid and said globules are pulled along said second parts from said low pressure areas to higher pressure areas in said first fluid and into said first fluid, wherein each of said elongate elements is curved in a downstream direction in a plane parallel to the direction of relative motion between said elongate elements and said first fluid, said first parts being essentially perpendicular to said direction, and tips of said second parts forming no more than a small angel with said direction.

10. Apparatus according to claim 9 wherein said elongate elements are parabolic.

11. Apparatus according to claim 9 wherein said means for supporting comprises duct means for directing the flow of said first fluid, said duct means having a cross-sectional area throughout its length such that the mean velocity of said flow is constant.

12. Apparatus according to claim 11 wherein said elongate elements are arranged in tiers spaced vertically along said duct to operate at substantially equal pressures.

13. Apparatus according to claim 12 wherein said duct comprises an inclined ramp over which said first fluid flows.

14. Apparatus according to claim 13 wherein said ramp is curved.

15. Apparatus according to claim 9, wherein said means for supporting comprises an inclined ramp over which said first fluid flows and wherein said elongate elements extending outwardly from said ramp into said first fluid.

16. Apparatus according to claim 15 wherein said ramp is curved.

17. Apparatus according to claim 9 comprising a channel for receiving a flow of said first fluid therethrough, and flotation means attached to said channel whereby said channel is buoyantly supported in said first fluid.

18. Apparatus according to claim 17 further comprising pump means for pumping said first fluid into said channel.

19. The apparatus of claim 9 wherein said elongate elements extend outwardly from a body which is adapted to rotate in said first fluid.

20. The apparatus of claim 19 wherein said means for supplying said second fluid is a passage attached to said body for communicating with said low pressure area created by elongate elements.

21. The apparatus of claim 20 wherein each of said plurality of elongate elements extends outward from said body and being curved in a direction opposite the direction of rotation of said body.

22. A method for mixing a first fluid with a second fluid comprising providing an elongate element, causing said first fluid to flow past said elongate element, and supplying said second fluid, wherein said elongate element comprises a first part for creating a local low pressure area in said first fluid on the lee side of said first part for inducting said second fluid and forming globules of said second fluid, the pressure of said low local pressure area being lower than the pressure in said first fluid adjacent said local low pressure area, said elongate element having a second part for transporting said globules into said first fluid, said elongate element being curved whereby said first part forms a first angle with the direction of flow of said first fluid and said second part forms a second angle with said direction of flow, said second angle being smaller than said first angle, wherein said step of supplying comprises supplying said second fluid to said local low pressure area, and said step of providing comprises arranging said elongate element with respect to said flow of said first fluid so that at least a component of said flow is parallel to said second part whereby said globules are pulled along said second part from said local low pressure area into a higher pressure area in said first fluid and into said flow.

23. A method according to claim 22 wherein said step of providing comprises providing a plurality of adjacent said elongate elements.

24. A method according to claim 23 wherein said step of causing said first fluid to flow comprises providing an inclined flow channel having said plurality of elongate elements in a wall thereof.

25. A method according to claim 24 wherein said wall is a curved bottom wall.

26. A method according to claim 24 wherein said flow channel is vertical.

27. A method according to claim 24 wherein said plurality of elongate elements are arranged in tiers and vertically spaced so that elements of said tiers operate at substantially equal pressures.

28. Apparatus for mixing a first fluid with a second fluid comprising an elongate element, means for supporting said elongate element to extend into said first fluid to permit relative motion between said first fluid and said elongate element, and supply means for supplying said second fluid, said elongate element comprising a first part for creating a local low pressure area in said first fluid on a downstream side of said first part when said fluid moves with respect to said elongate element, the pressure of said local low pressure area being lower than the pressure in said first fluid adjacent said local low pressure area, said elongate element further comprising a second part connected to said first part and extending into said first fluid beyond said first part, said elongate element being curved whereby said first part forms a first angle with the direction of flow of said first fluid and said second part forms a second angle with said direction of flow, said second angle being smaller than said first angle, wherein said supply means supplies said second fluid to said local low pressure area to form globules of said second fluid and said globule is pulled along said second part from said low pressure area to a higher pressure area in said first fluid and into said first fluid.

29. Apparatus according to claim 28 comprising a plurality of said elongate elements supported by said means for supporting.

30. Apparatus according to claim 29 wherein said means for supporting is an inclined channel having said elongate elements in a wall thereof.

31. Apparatus according to claim 30 wherein said wall is curved.

32. Apparatus according to claim 30 wherein said channel is vertical.

33. Apparatus according to claim 29 wherein said elongate elements are arranged in tiers which ar vertically spaced so that the elements of said tiers operate at substantially equal pressures.

* * * * *